US006484517B2

(12) United States Patent
Levitin et al.

(10) Patent No.: US 6,484,517 B2
(45) Date of Patent: Nov. 26, 2002

(54) COMPRESSOR OIL PRESSURE CONTROL METHOD AND UNIT

(75) Inventors: Mikhail Levitin, P.O. Box 102, Reeders, PA (US) 18352; Boris Khaytin, P.O. Box 102, Reeders, PA (US) 18352

(73) Assignees: Mikhail Levitin, Reeders, PA (US); Boris Khaytin, Reeders, PA (US)

( * ) Notice: Subject to any disclaimer, the term of this patent is extended or adjusted under 35 U.S.C. 154(b) by 2 days.

(21) Appl. No.: 09/793,272

(22) Filed: Feb. 27, 2001

(65) Prior Publication Data

US 2002/0116940 A1 Aug. 29, 2002

(51) Int. Cl.[7] ..... F25B 43/02; F25B 31/00

(52) U.S. Cl. ..... 62/84; 62/471; 62/193

(58) Field of Search ..... 62/84, 471, 468, 62/470, 192, 193, 228.1

(56) References Cited

U.S. PATENT DOCUMENTS

| | | | | | |
|---|---|---|---|---|---|
| 2,145,354 | A | * | 1/1939 | Hull | 62/471 |
| 3,636,723 | A | * | 1/1972 | Kramer | 62/197 |
| 4,187,695 | A | * | 2/1980 | Schumacher | 62/503 |
| 4,429,544 | A | * | 2/1984 | McCarty | 62/84 |
| 4,503,685 | A | * | 3/1985 | DiCarlo et al. | 62/193 |
| 5,165,248 | A | * | 11/1992 | Sishtla | 62/84 |
| 5,634,345 | A | * | 6/1997 | Alsenz | 62/84 |
| 5,675,978 | A | * | 10/1997 | Hamm et al. | 62/84 |
| 5,724,821 | A | * | 3/1998 | Lord et al. | 62/84 |
| 5,761,914 | A | * | 6/1998 | Carey et al. | 62/84 |
| 5,884,494 | A | * | 3/1999 | Okoren et al. | 62/126 |
| 6,041,605 | A | * | 3/2000 | Heinrichs | 62/84 |
| 6,125,642 | A | * | 10/2000 | Seener et al. | 62/193 |

* cited by examiner

*Primary Examiner*—William C. Doerrler

(57) ABSTRACT

The present invention relates to the art of refrigeration and more particularly to a method of regulating the cooling process by controlling the oil pressure in a compressor. The system prevents the accumulation of the liquid refrigerant in the crankcase of the compressor and allows a compressor to continue to work without interruption.

5 Claims, 2 Drawing Sheets

COMPRESSOR OIL PRESSURE CONTROL METHOD AND UNIT

BACKGROUND OF THE INVENTION

1. Field of the Invention

The present invention relates to refrigeration systems using different refrigerants that dissolve lubricant, and with compressors having a casting for storing oil delivered by a pump for lubrication of their bearings, and more specifically to a method for controlling compressor oil pressure in the systems where oil is returned to the compressor from the evaporator.

2. Background of the Prior Art

Oil is usually used to lubricate refrigeration compressors. The oil pressure of a compressor must be sufficient to support the minimal necessary amount of oil lubricant. If the oil pressure falls below a pressure necessary to support that minimal required amount of lubricant, the compressor can be damaged. That is why refrigeration systems have a special device to turn the compressor off when the pressure of the oil in the system reaches the minimum level. The oil from the compressor is evacuated with the refrigerant vapor. After the evaporation of the liquid refrigerant has taken place in the evaporator of the refrigeration system, the oil returns to the compressor either by refrigerant vapors or separately from the refrigerant.

In U.S. Pat. No. 3,978,685 by M. Taylor, issued Jul. 14, 1975, the oil returns to the compressor with the refrigerant vapors from the evaporator. In this case a certain amount of liquid refrigerant can enter the compressor along with the oil. This cannot be evaporated by the same method as in the evaporator. The oil pressure drops and a blocking device turns the compressor off. A certain amount of time and special preparations are required to restart the compressor again.

A similar situation is described in U.S. Pat. No. 4,631,926 by Goldstein, et. al., issued on Dec. 30, 1986, which states that when the oil carrying liquid refrigerant separates from the vapor, the refrigerant moves to the compressor through a special thermal exchange heater. A significant amount of the refrigerant returns with the oil to the compressor due to the existing inertia of the system, which supports a temperature level of the mixture of the oil and the refrigerant. It leads to the same disadvantages of the system as in U.S. Pat. No. 3,978,685.

SUMMARY OF THE INVENTION

The present invention relates to a method of controlling the oil pressure in a compressor in order to allow it to work without interruption. This can be accomplished by the use of the following method. Practice shows that the oil pressure changes step-wise when the liquid refrigerant is accessing into the compressor. At the beginning, the pressure does not drop significantly and stays higher then the allowed minimum. As the liquid refrigerant continues to enter the compressor, the oil pressure drops significantly and reaches a critically low level. When the oil along with the liquid refrigerant is prevented from entering the compressor immediately after the first drop of pressure, the oil pressure will be elevated. The elevation in pressure is due to the extraction of the excess amount of liquid refrigerant from the oil in the compressor. Thereafter, the compressor can continue to work without interruption.

BRIEF DESCRIPTION OF THE DRAWING FIGURES

DETAILED DESCRIPTION

Figure 1:
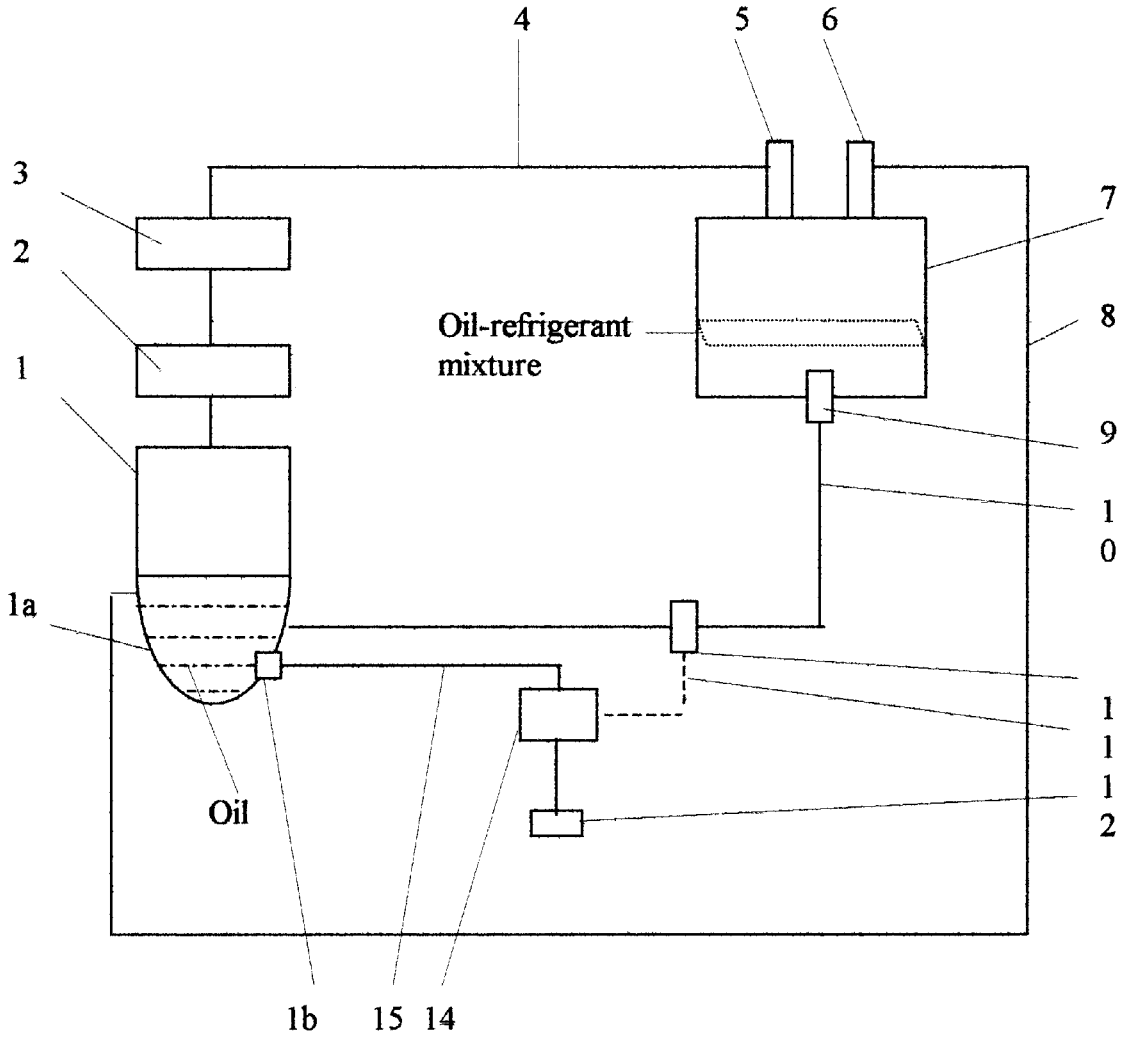
FIG. 1 illustrates a schematic representation of the unit in which oil together with the liquid refrigerant is returned to the compressor.

FIG. 1 depicts a closed circuit system consisting of a compressor 1 with casting 1*a*, suction line 8, condenser 2, evaporator 3, suction accumulator 7 with inlet 5 connected to said evaporator 3 by line 4, two outlets 6 and 9, said outlet 6 connected to said compressor 1 by said suction line 8, said outlet 9 connected to said casting 1*a* by oil return line 10, and controller 11 placed on said oil return line 10 to adjust the oil-refrigerant mixture flow. Regulator 13 with set-point adjustment 14 is connected to said compressor 1 by line 15 and electrically connected to said controller 11 by line 12.

Refrigerant vapor compressed in the compressor 1 enters the condenser 2 where it becomes a liquid and enters the evaporator 3 where it is boiled. The refrigerant vapor containing oil enters the suction accumulator 7 through line 4 and then through inlet 5. The mixture is separated in said suction accumulator 7 into a vapor and a liquid part containing mainly oil and some liquid refrigerant. The mixture containing oil and liquid refrigerant is drawn to the compressor 1 from the suction accumulator 7 through outlet 9 by return line 10. When the initial part of this mixture, containing an excess of liquid refrigerant, enters said casting 1*a* of said compressor 1, the oil pressure in said compressor 1 immediately decreases to a level that is still above the minimum level allowed for the bearings (not shown) of said compressor 1 to work safely. Regulator 13 monitors the oil pressure value of the compressor 1 and compares this pressure value to that installed on set-point adjustment 14. When this first reduction of oil pressure occurs, the controller 11 closes the line 10 and prevents the entrance of liquid oil-refrigerant mixture into the compressor 1. In a short period of time liquid refrigerant in the compressor 1 evaporates, the oil pressure increases, the regulator 13 opens the controller 11, and the oil continues to return to the compressor 1. This system provides an uninterrupted safe operation of the compressor.

Figure 2:
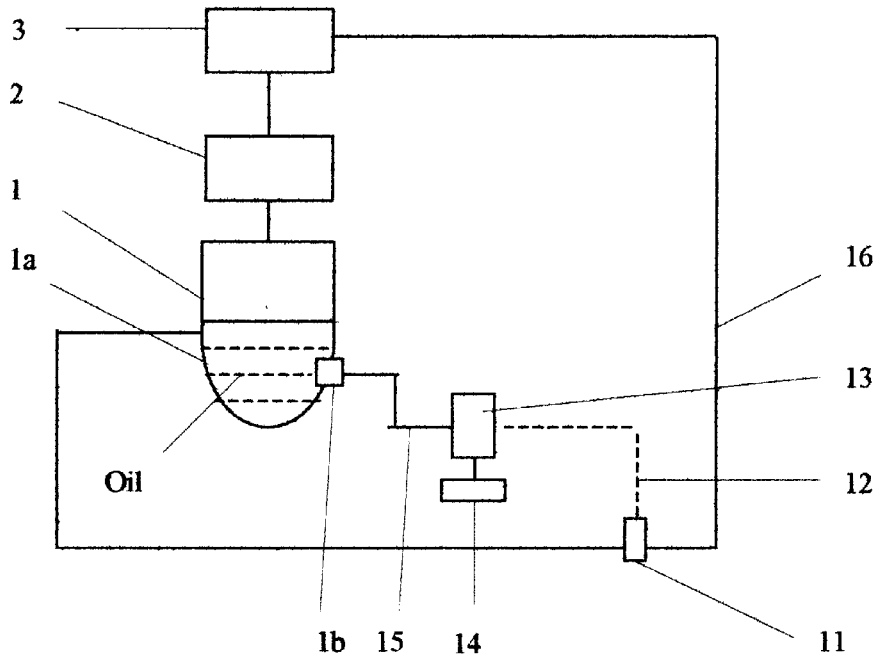
FIG. 2 illustrates a schematic representation of an alternative embodiment of the unit where oil is returned to the compressor together with refrigerant vapor.

FIG. 2 depicts a closed circuit system consisting of compressor 1 with casting 1*a*, suction line 16, condenser 2, evaporator 3 connected by said suction line 16 to said compressor 1 and to said condenser 2, and controller 11 which is placed on said suction line 16. Regulator 13 with set-point adjustment 14 is connected to said compressor 1 by line 15 and electrically connected to said controller 11 by line 12.

Refrigerant vapor becomes compressed in the compressor 1 and enters the condenser 2 where it becomes a liquid and enters the evaporator 3 where it is boiled. The refrigerant vapor containing oil is drawn to the compressor 1 by suction line 16. When the initial part of this mixture containing an excess of liquid refrigerant enters the casting 1*a* of said compressor 1, and the oil pressure in said compressor 1 immediately decreases to a level that is still above the minimum level allowed for the bearings (not shown) of said compressor 1 to work safely. The regulator 13 monitors the oil pressure value of the compressor 1, comparing this pressure value to the one established on set point adjuster 14. Controller 11 closes the line 16 when the target pressure is reached. This prevents the entrance of liquid oil-refrigerant mixture into the compressor 1. In a short period of time liquid refrigerant in the compressor 1 evaporates, the oil pressure increases, the regulator 13 opens the controller 11 and the oil continues to return to the compressor 1. This system provides uninterrupted safe operation of the compressor.

Figure 3:
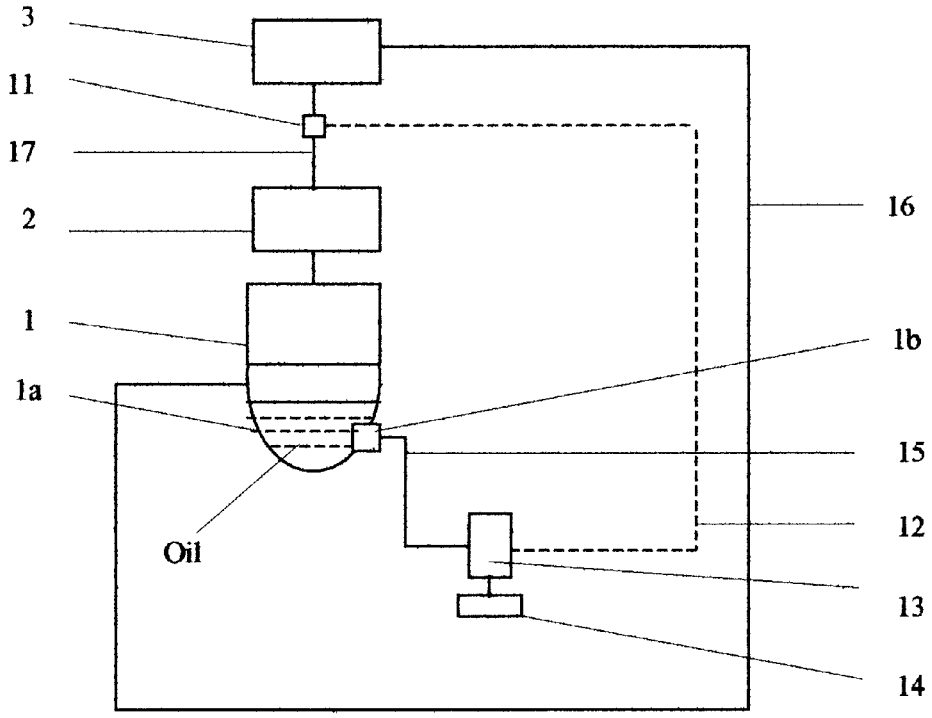
FIG. 3 illustrates a schematic representation of an alternative embodiment of the unit where oil is returned to the compressor together with refrigerant vapor, with a controller placed on the line connected to a condenser and an evaporator.

FIG. 3 depicts a closed circuit system consisting of compressor 1 with casting 1*a*, suction line 16, condenser 2, evaporator 3 connected by said suction line 16 to said compressor 1 and connected to said condenser 2 by line 17, and controller 11 which is placed on said line 17. Regulator 13 connected to said compressor 1 by line 15, and electrically connected to said controller 11 by line 12.

Refrigerant vapor compresses in the compressor 1 and enters the condenser 2 where it becomes a liquid and enters the evaporator 3 where it is boiled. The refrigerant vapor containing oil is drawn to the compressor 1 by suction line 16. When the initial part of this mixture containing an excess of liquid refrigerant enters the casting 1*a* of said compressor 1, the oil pressure in said compressor 1 immediately decreases to a level that is still above the minimum level allowed for the bearings (not shown) of said compressor 1 to work safely. The regulator 13 monitors the oil pressure value of the compressor 1, comparing this pressure value to the one installed on the set-point adjuster 14, and closes the line 17 by means of controller 11. Controller 11 closes the line 16 when the target pressure is reached. This prevents the entrance of liquid oil-refrigerant mixture into the compressor 1. In a short period of time liquid refrigerant in the compressor 1 evaporates, the oil pressure increases, the regulator 13 opens the controller 11, and the oil continue to return to the compressor 1. This system provides an uninterrupted safe operation of the compressor.

While this invention has been illustrated and described in accordance with the preferred embodiments, it is recognized that variations and changes may be made therein without departing from the invention as set forth in the claims.

We claim:

1. A method of controlling the compressor oil pressure in the closed circuit system consisting of an evaporator, a suction accumulator with an inlet connected to said evaporator and two outlets one of which is connected to a suction line of said compressor and another connected by the oil return line to said casting of said compressor, a controller which is placed on said oil return line, a regulator with a set-point adjustment connected to said compressor and electrically connected to said controller, and consisting of the following steps:

feeding refrigerant vapor into the compressor;

compressing the refrigerant vapor;

transforming the vapor into a liquid;

boiling liquid refrigerant in the evaporator;

separating refrigerant vapor from the mixture of oil and liquid refrigerant;

feeding vapor refrigerant to the compressor;

feeding the oil-liquid refrigerant mixture to the compressor;

monitoring oil pressure in the compressor;

comparing the value of the oil pressure to an established target value;

preventing the entrance of oil-liquid refrigerant mixture into the compressor if the value of the oil pressure in the compressor corresponds to a value installed on a set-point adjustment or allowing the entrance of oil-liquid refrigerant into the compressor if the oil pressure in the compressor is more than the value installed on the set-point adjustment.

2. A method of controlling the compressor oil pressure in the closed circuit system consisting of a compressor with casting, a suction line, a condenser, an evaporator connected to said suction line of said compressor and to said condenser, a controller placed on said suction line, and a regulator with set-point adjustment connected to said compressor and electrically connected to said controller, and consisting of the following steps:

feeding refrigerant vapor into the compressor;

transforming vapor into liquid;

boiling liquid refrigerant in the evaporator;

feeding vapor refrigerant to the compressor;

monitoring oil pressure in the compressor;

comparing the value of oil pressure to an established target value;

preventing the entrance of oil-refrigerant vapor mixture into the compressor if the value of the oil pressure in the compressor corresponds to a value installed on a set-point adjustment or allowing the entrance of oil-refrigerant vapor into the compressor if the oil pressure in the compressor is more than the value installed on a set-point adjustment.

3. A closed circuit system consists of a compressor with a casting, a suction line, a condenser, an evaporator, a suction accumulator with an inlet connected by a line to said evaporator and two outlets one of which is connected to said compressor with a suction line, and another is connected to said compressor by returned line, a controller placed on said returned line, and a regulator with set-point adjustment connected to said compressor and electrically connected to said controller.

4. A closed circuit system consists of a compressor with a casting, a suction line, a condenser, an evaporator connected to said suction line of said compressor and to said condenser, a controller placed on said suction line, a regulator with set-point adjustment to control the oil pressure and connected to said compressor and electrically connected to said controller.

5. A closed circuit system consists of a compressor with a casting, a suction line, a condenser, an evaporator connected to said suction line of said compressor and to said condenser, a controller placed on the line connecting said condenser with said evaporator, and a regulator with set-point adjustment to control the oil pressure and connected to said compressor and electrically connected to said controller.

* * * * *